US007683734B2

(12) United States Patent
Catoiu

(10) Patent No.: US 7,683,734 B2
(45) Date of Patent: Mar. 23, 2010

(54) RF RE-ENTRANT COMBINER

(75) Inventor: Miron Catoiu, Kitchener (CA)

(73) Assignee: Raytheon Canada Limited, Ontario (CA)

( * ) Notice: Subject to any disclaimer, the term of this patent is extended or adjusted under 35 U.S.C. 154(b) by 137 days.

(21) Appl. No.: 11/686,676

(22) Filed: Mar. 15, 2007

(65) Prior Publication Data

US 2008/0224797 A1 Sep. 18, 2008

(51) Int. Cl.
*H01P 5/12* (2006.01)
*H01P 3/06* (2006.01)

(52) U.S. Cl. ..... 333/115; 333/109

(58) Field of Classification Search ..... 333/112, 333/113, 109, 115, 116
See application file for complete search history.

(56) References Cited

U.S. PATENT DOCUMENTS

| | | | | |
|---|---|---|---|---|
| 3,237,130 | A * | 2/1966 | Cohn | 333/115 |
| 3,593,208 | A | 7/1971 | Smith | |
| 4,240,051 | A | 12/1980 | Haugsjaa et al. | 333/127 |
| 5,159,298 | A | 10/1992 | Dydyk | |
| 5,334,958 | A * | 8/1994 | Babbitt et al. | 333/156 |
| 5,796,317 | A | 8/1998 | Bohlman et al. | 333/127 |
| 5,872,491 | A | 2/1999 | Kim et al. | 333/101 |
| 6,005,442 | A | 12/1999 | Maeda et al. | 333/295 |
| 6,275,120 | B1 * | 8/2001 | Vaninetti et al. | 333/161 |
| 6,400,235 | B1 * | 6/2002 | Perez | 333/113 |
| 6,483,397 | B2 | 11/2002 | Catoiu | 333/116 |
| 6,794,954 | B2 | 9/2004 | Gurvich et al. | |
| 6,825,738 | B2 | 11/2004 | Shumovich | |
| 6,952,147 | B2 | 10/2005 | Gurvich et al. | |
| 6,972,638 | B2 * | 12/2005 | Usami et al. | 333/109 |
| 7,026,888 | B2 | 4/2006 | Antkowiak | 333/127 |
| 7,429,903 | B2 * | 9/2008 | Antkowiak | 333/115 |

FOREIGN PATENT DOCUMENTS

WO 2004/062026 7/2004

OTHER PUBLICATIONS

Merriam Webster's Collegiate Dictionary, Tenth Edition, p. 3, 2000.*
PCT Search Report of the ISA for PCT/CA2007/002334 dated Apr. 16, 2008.
Cohn; The Re-Entant Cross Section and Wide-Band 3-db Hybrid Couplers; IEEE Transactions on Microwave Theory and Techniques; Jul. 1963; pp. 254-258.

* cited by examiner

*Primary Examiner*—Dean O Takaoka
(74) *Attorney, Agent, or Firm*—Daly, Crowley, Mofford & Durkee, LLP

(57) ABSTRACT

Various embodiments are described herein for a combiner. The combiner includes first and second transmission lines, a dielectric material disposed about the first and second transmission lines, an intermediate conductor arrangement disposed about the dielectric material, and an outer conductor arrangement disposed about the intermediate conductor. The dielectric material has a dielectric constant higher than that of air, and the intermediate conductor arrangement has reactive portions.

21 Claims, 6 Drawing Sheets

RF RE-ENTRANT COMBINER

FIELD OF THE INVENTION

Embodiments are described herein for electronic devices that can be used to couple and/or combine high-power electrical signals in the RF or microwave range.

BACKGROUND OF THE INVENTION

Power combiners and directional couplers are passive microwave devices that can be used to combine electrical signals in the radio frequency (RF) range (i.e. frequencies in the range of about 3-300 MHz) or microwave frequency range (i.e. frequencies above about 300 MHz). Power combiners can be used in amplifier modules that comprise multiple unit amplifiers. For instance, an amplifier module may include four unit amplifiers and the output of each unit amplifier can be combined together using a 4:1 combiner to produce the required total output power of the amplifier module.

With the advancement of transistor technology in the RF and microwave frequency ranges, it is now possible to generate higher RF power levels using semiconductor devices. Accordingly, a need exists for compact stripline/coaxial combiners which can reliably combine RF and microwave signals having power levels in the range of about 10 kW and above.

However, current combiner technology that uses air suspended stripline or classic stripline/microstrip technology has insufficient thermal dissipation for the power levels which the combiner will be subjected to. In addition, the coupling performance of the combiners can be sensitive to thermal expansion and very sensitive to misalignment. Furthermore, waveguide technology is too large to be used in combiners for certain applications.

BRIEF DESCRIPTION OF THE DRAWINGS

For a better understanding of the embodiments described herein, and to show more clearly how they may be carried into effect, reference will now be made, by way of example only, to the accompanying drawings in which.

DETAILED DESCRIPTION

Figure 1:
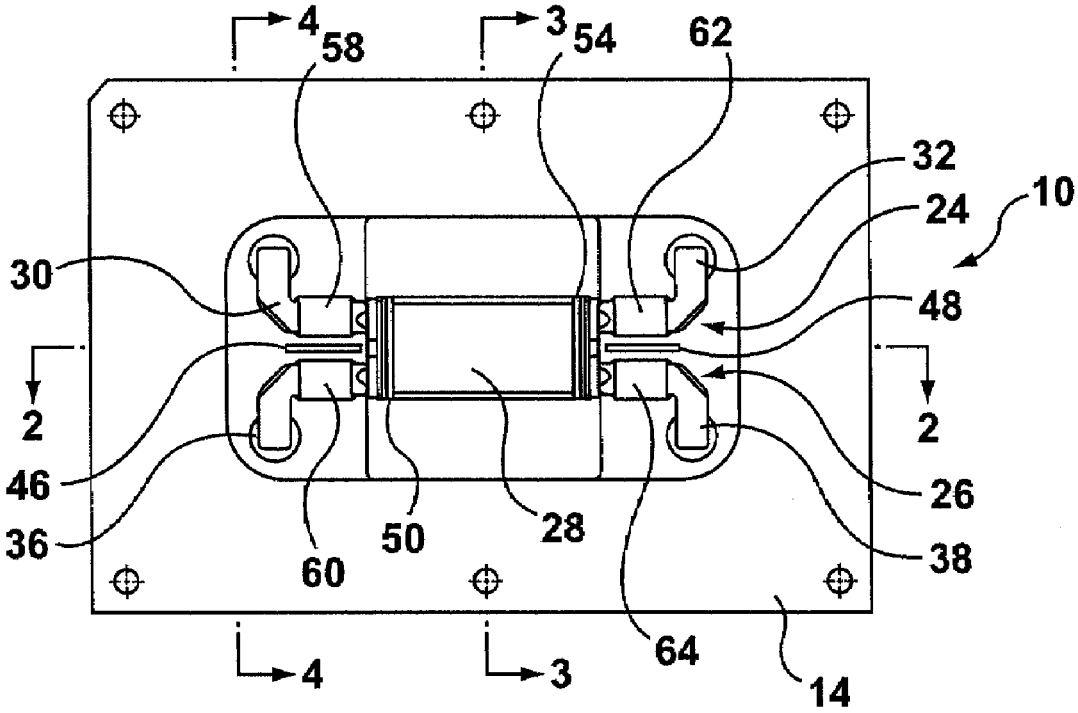
FIG. 1 is a top view of an exemplary embodiment of a combiner with the housing cover removed.
Figure 2:
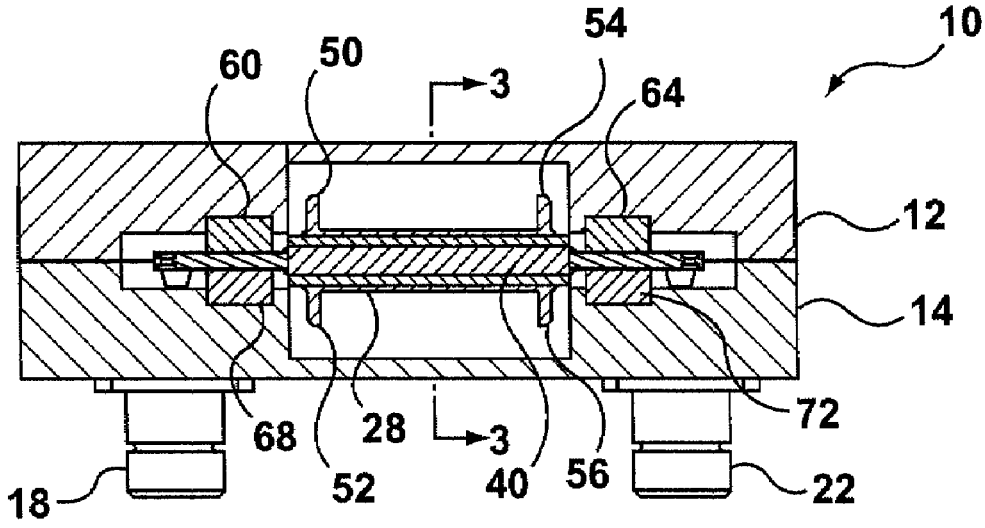
FIG. 2 is a cross-sectional front view of the combiner of FIG. 1 with the housing cover shown.
Figure 3:
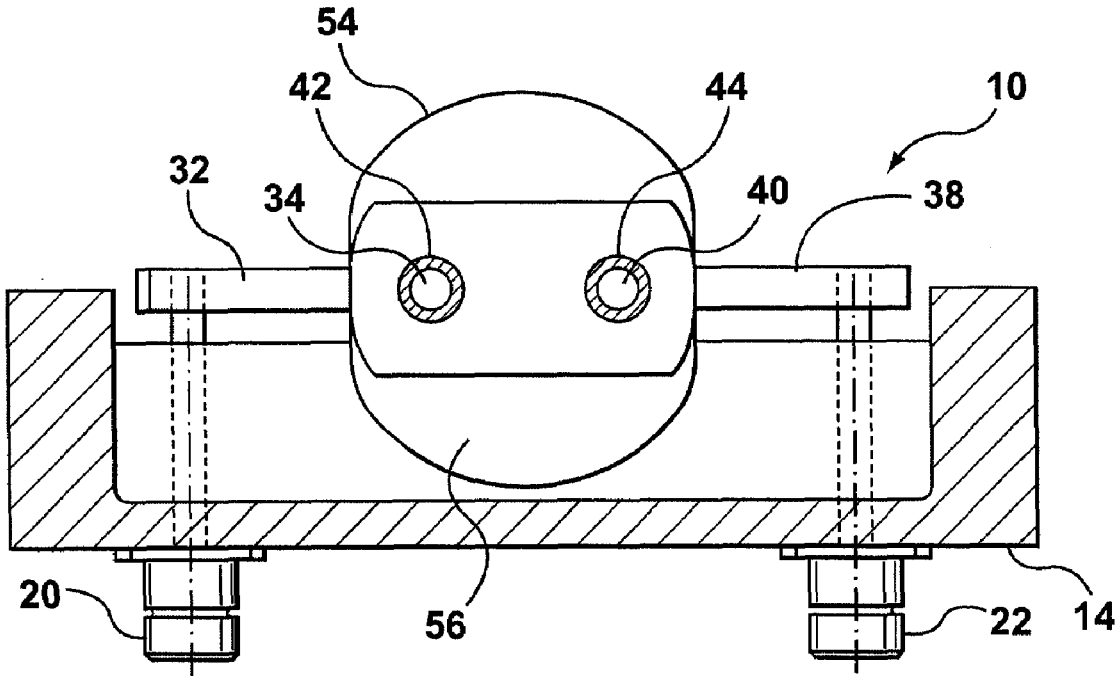
FIG. 3 is a cross-sectional end view of the combiner of FIG. 1 with the housing cover removed.
Figure 4:
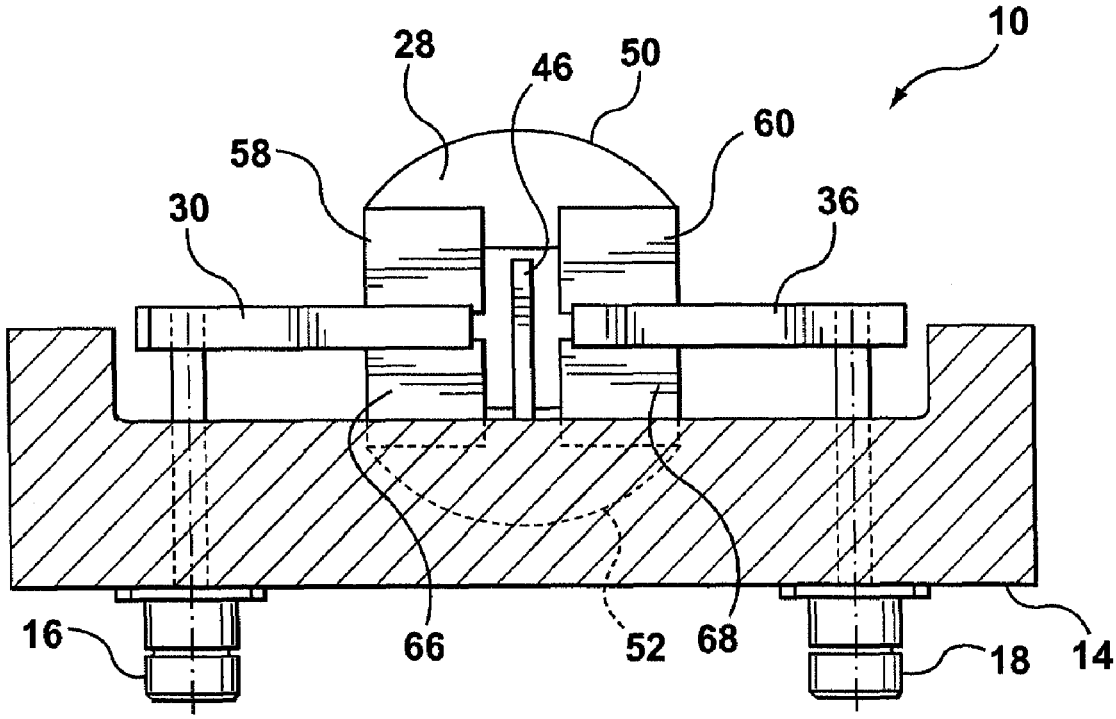
FIG. 4 is another cross-sectional end view of the combiner of FIG. 1 with the housing cover removed.
Figure 5:
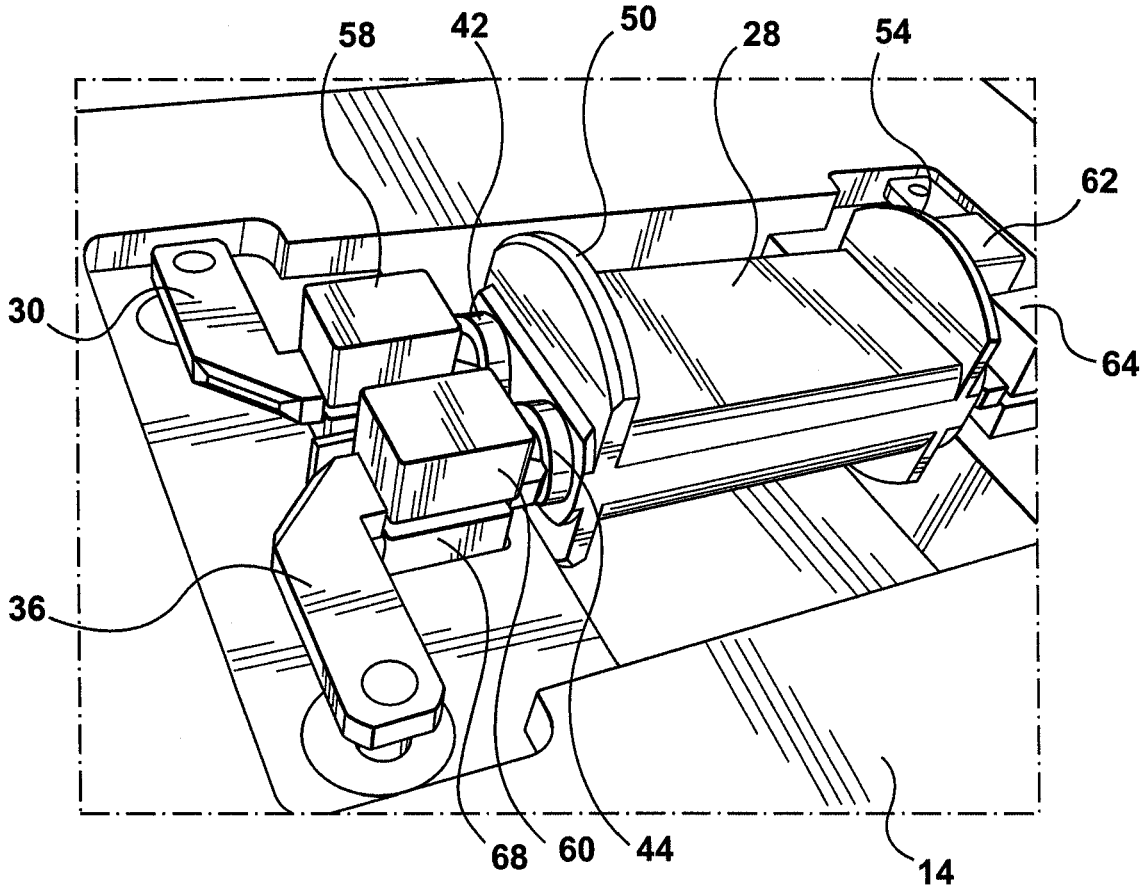
FIG. 5 is a perspective view of the combiner of FIG. 1 with the housing cover removed.

It will be appreciated that for simplicity and clarity of illustration, where considered appropriate, reference numerals may be repeated among the figures to indicate corresponding or analogous elements or steps. In addition, numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail since these are known to those skilled in the art. Furthermore, it should be noted that this description is not intended to limit the scope of the embodiments described herein, but rather as merely describing one or more exemplary implementations. It should also be noted that the term combiner used herein can be interchanged with the terms "directional coupler", "re-entrant combiner", and "re-entrant coupler".

Referring now to FIGS. 1-5, shown therein are various views of an exemplary embodiment of a combiner 10. The combiner 10 includes a housing having an upper portion 12 (i.e. cover), and a lower portion 14 (i.e. a base), a plurality of ports 16-22, two transmission lines 24 and 26, and a floating intermediate conductor 28. The upper and lower portions 12 and 14 of the housing are conductive and provide an outer conductor arrangement as well as an electrical ground for the combiner 10. The floating intermediate conductor 28 provides an intermediate conductor arrangement for the combiner 10. The ports 16-22 are standard N connectors (50 ohm). However, other suitable connectors may also be used. The combiner 10 also includes shield elements 46 and 48 connected to ground to prevent parasitic coupling between the portion of the transmission lines 24 and 26 that are outside of the intermediate conductor 28.

The transmission line 24 includes thick strip conductors 30 and 32 and a coaxial conductor portion 34. The transmission line 26 includes thick strip conductor portions 36 and 38 and a coaxial conductor portion 40. The particular thickness to be used for any conductor in any particular application is selected based upon a variety of factors including but not limited to the heat transfer characteristic required for the particular application, the frequency of operation, the desired characteristic impedances of the transmission lines and mechanical constraints/requirements. Those of ordinary skill in the art will appreciate how to assess the relevant factors and select a particular thickness. The coaxial conductor portions 34 and 40 within the intermediate conductor 28 have a length of one-quarter wavelength with regards to the operating frequency of the combiner 10. The thick strip conductor portions 30, 32, 36 and 38 almost resemble square coaxial conductors and are spaced from the surfaces of the upper and lower portions 12 and 14 of the housing by a certain distance for maintaining a suitable impedance match along these portions of the transmission lines 24 and 26. The thick strip conductor portions 30, 32, 36 and 38 have a low loss, good thermal conduction, and can handle a large amount of peak power (in theory in excess of 90 kW). In alternative embodiments, the coaxial conductor portions 34 and 40 can be replaced with thick strip conductors. In yet other alternative embodiments, the thick strip conductor portions 30, 32, 36 and 38 can be replaced with coaxial conductors. However, this results in the ground plane separation in these portions of the transmission lines 24 and 26 being much lower than in the stripline case, which decreases the peak power capability.

The floating intermediate conductor 28 is tubular in nature and includes channels for receiving the coaxial conductor portions 34 and 40 in a concentric fashion. The channels of the intermediate conductor 28 also receive dielectric materials 42 and 44, which are disposed about the coaxial conductor portions 34 and 40. In this exemplary embodiment, the dielectric material 42 and 44 have a cylindrical shape with a circular bore to accommodate the coaxial conductors 34 and 40; i.e. the dielectric material 42 and 44 both have a sleeve-like form. The intermediate conductor 28 is electrically insulated from the outer conductor arrangement. The intermediate conductor 28 is also insulated from the transmission lines 24 and 26. Also, there is no direct coupling between the two transmission lines 24 and 26 and it appears that the intermediate conductor 28 is shielding the coaxial conductor portions 34 and 40 from each other. However, there is in fact an additional transmission line between the intermediate conductor 28 and the outer conductor arrangement, which is in series with the two transmission lines 24 and 26 and acts as a mutual coupling medium. In alternative embodiments, the cross-sectional shape of the floating intermediate conductor 28 can be round, elliptic or any other suitable shape. Furthermore, the dielectric material 42 and 44 may not form continuous sleeves. For instance, the dielectric materials 42 and 44 can include several small cylindrical pieces that are spaced apart from one another or one cylinder having holes. Many different arrangements can be suitable in this regard. Ceramic cylinders can also be used for the dielectric materials provided that the heat transfer properties are sufficient for high power applications.

In use, the combiner 10 provides coupling between RF signals provided to the transmission lines 24 and 26. For example, ports 16 and 20 can act as an input port and an output port, respectively, for transmission line 24. Further, ports 18 and 22 can act as a coupled port and an isolated port, respectively, for transmission line 26. An input signal at port 16 can be coupled to the port 18, such that the power of the input signal at port 16 is distributed between ports 18 and 20, while port 22 does not receive any power. The amount of signal distribution depends on the amount coupling between the transmission lines 24 and 26. Alternatively, input signals can be provided to both ports 16 and 18, such that the combined power from these input signals are provided to the port 20, while port 22 does not receive any power. In order to provide this behaviour, the even and odd mode propagation constants, also known as the even and odd mode propagation velocities, need to be balanced for the combiner 10. The propagation velocities can be determined in terms of even and odd mode characteristic impedances.

The even mode characteristic impedance $Z_{oe}$ is measured with respect to one of the inner coaxial conductor portions and the outer conductor arrangement when the magnitude and phase of the RF voltage and current of the coaxial conductor portions 34 and 40 are equal. The odd mode characteristic impedance $Z_{oo}$ is measured with respect to one of the inner coaxial conductor portions and the outer conductor arrangement when the RF voltage and current of the coaxial conductor portions 34 and 40 are equal in magnitude but 180 degrees out of phase. The characteristic impedance of the transmission line consisting of one of the inner transmission lines 24 or 26 and the intermediate conductor 28 is represented by $Z_{o2}$ while the characteristic impedance of the transmission line between the outer conductor arrangement and one of the coaxial conductor portions is represented by $Z_{o1}$. The odd mode characteristic impedance $Z_{oo}$ is equal to $Z_{o2}$ while the even mode characteristic impedance $Z_{oe}$ is equal to $Z_{o2}+2Z_{o1}$. The characteristic impedances $Z_{oe}$ and $Z_{oo}$ are not equal for coupled conductors, and for tighter coupling such as 3 dB, there is a large difference between the characteristic impedances $Z_{oe}$ and $Z_{oo}$. Those skilled in the art are knowledgeable in selecting values for the characteristic impedances $Z_{oe}$ and $Z_{oo}$ to achieve a certain amount of coupling between the transmission lines 24 and 26.

In order to have an isolated port for the combiner 10, the propagation velocity inside and outside the intermediate conductor 28 should be balanced, or at least as similar as is possible in practice. In other words, the propagation velocity (or propagation constant) in the transmission line defined above as $Z_{oo}$, which can be referred to as the odd mode propagation constant since it corresponds with odd mode excitation, must be as similar as is practically possible with the propagation velocity (or propagation constant) in the transmission line defined above as $Z_{oe}$, which can be referred to as the even mode propagation constant since it corresponds to even mode excitation. One way to ensure this is to use the same dielectric material between the coaxial conductor portions and the intermediate conductor arrangement, and between the intermediate conductor arrangement and the outer conductor arrangement. Indeed, previous combiners have used only air as the dielectric in both of these regions so that the even and odd mode propagation constants are as similar as is practically possible.

However, for combiners that have higher RF power requirements, it is not acceptable to use air as a dielectric since the thermal heat transfer characteristics of air are not suitable for use in high power applications. Rather, the combiner 10 utilizes the dielectric material 42 and 44 to provide enhanced thermal or heat transfer pathways for increased heat dissipation from the coaxial conductor portions 34 and 40 of the transmission lines 24 and 26. This enables the combiner 10 to handle higher power RF signals since any generated heat can be dissipated more quickly. The dielectric material 42 and 44 is made from a dielectric that has a good thermal conductivity. For example, the dielectric material can be Boron-Nitride loaded Teflon, which has very good thermal conductivity. Other materials can be used, like ceramics such as beryllium oxide (BeO) for example. However, with certain materials, it may be more difficult to balance the velocities. Accordingly, with certain alternative dielectric materials, it may be necessary to use alternate forms rather than a sleeve shape for the dielectric materials 42 and 44 to vary the effective dielectric constant of the dielectric materials 42 and 44.

However, by adding the dielectric material 42 and 44, the odd and even mode propagation constants are no longer balanced, because the velocity will be lower in the odd mode. For a given length, this will make the transmission line $Z_{oo}$ appear to be electrically longer. To compensate for this, one approach is to make the transmission line $Z_{oe}$ have an electrical length that is as similar as is practically possible to the electrical length of the transmission line $Z_{oo}$. Accordingly, the intermediate conductor 28 is modified to increase the electrical length of the transmission line $Z_{oo}$ such that directivity is preserved, i.e. the port 22 is isolated, even though the even and odd mode propagation constants appear to be unequal due to dielectric loading within the intermediate conductor 28. More specifically, the intermediate conductor 28 is modified by the addition of reactive loads. The reactive loads can be capacitive loads. Accordingly, the intermediate conductor 28 includes capacitive portions 50 to 56.

To provide the combiner 10 with higher power handling ability, distributed capacitive portions are used. However, a distributed capacitor has finite dimensions, hence a non-zero electrical length. In the exemplary embodiment, the capacitive portions 50 to 56 are made with short lengths of a low impedance parallel plate transmission line. These parallel plate transmission lines can be considered to be in series with the transmission line $Z_{oe}$, so the total electrical length of $Z_{oe}+4_{cap}$ becomes equal with the electrical length of $Z_{oo}$. In this way, the odd and even mode propagation velocities have been virtually equalized at least as much as is practically possible. In order to estimate the actual amount of distributed capacitance that is required, a good starting point is that the intermediate conductor 28 must be longer by approximately the square root of the dielectric constant of the dielectric material used within the intermediate conductor 28. A 3D simulation program such as HFSS, CST or any other commercial or proprietary 3D simulator, known to those skilled in the art, can then be used to determine the amount of distributed capacitance that is required.

In this exemplary embodiment, the capacitive portions 50 to 56 have a semi-circular shape, which allows for creating a continuous variation of the total electrical length for $Z_{oe}$ in the plane that is perpendicular to the plane of the transmission lines 24 and 26. Accordingly, the compensation for electrical length in the even mode of propagation can be balanced over a certain frequency range. This means that for any frequency in the frequency range, an electrical length will exist across the capacitive portion in which the even and odd mode propagation velocities will be compensated. In alternative embodiments, different shapes can be used for the capacitive portions 50 to 56. However, the effect of compensation over a certain frequency range may no longer exist and there will be a lower bandwidth for electrical length compensation. Further, the semi-circular shapes do not have to be perpendicular to the longitudinal axis of the coax conductors 34 and 40. Furthermore, in alternative embodiments, each of the capacitive portions 50 to 56 do not have to be exactly the same, as long as the electrical length in the even and odd modes are equal.

The combiner 10 further includes a plurality of dielectric blocks 58-72 which provide an enhanced thermal pathway between the portions of the transmission lines 24 and 26 that are external of the intermediate conductor 28, and the outer conductor arrangement. Depending on the power requirements of the combiner 10, such as those that result from being used in a high peak power but low average power application, one or more or all of these dielectric blocks 58-72 can be removed. However, in high power applications, all of the dielectric blocks 58-72 should be used. The dielectric blocks 58-72 can be made from similar material as the dielectric material 42 and 44. Direct physical contact between the dielectric blocks 58-72 and the outer conductor arrangement also provides a better heat transfer pathway, and is needed for very high power applications.

Figure 6:
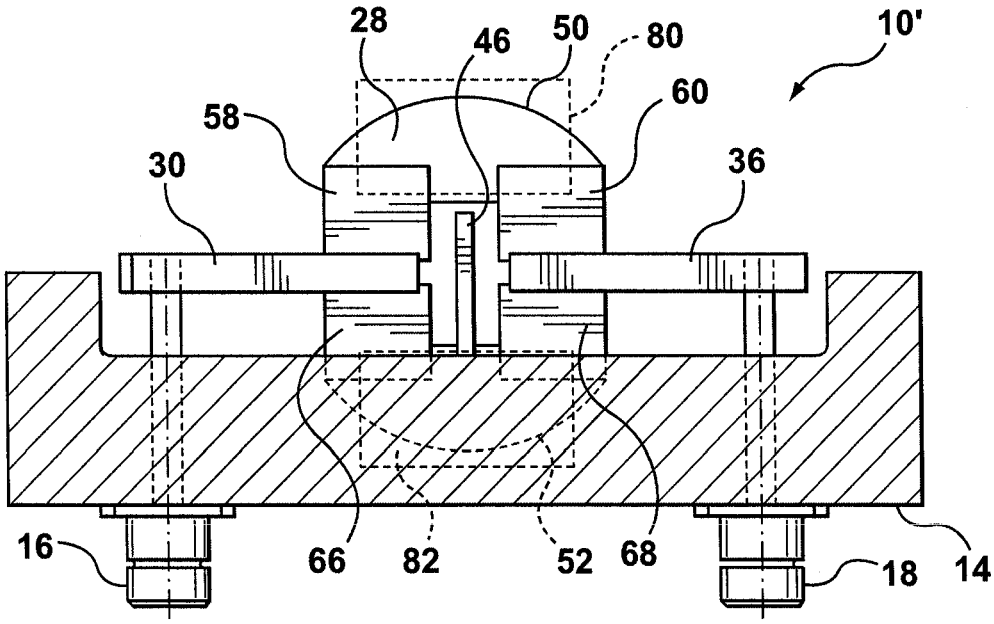
FIG. 6 is a cross-sectional end view of another exemplary embodiment of a combiner with the housing removed.

Referring now to FIG. 6, shown therein is a cross-sectional end view of another exemplary embodiment of a combiner 10' with the housing removed. The combiner 10' is similar to the combiner 10 but includes additional dielectric blocks 80 and 82. The combiner 10' can be used when there is a larger amount of RF power that is being coupled since the dielectric blocks 80 and 82 enable greater heat dissipation. For example, the combiner 10 can be used as a 3 dB coupler, while the combiner 10' can be used as a 4.77 or 6 dB coupler. The dielectric blocks 80 and 82 are placed on either side of the intermediate conductor 28 and touch both the intermediate conductor 28 and the outer conductor arrangement to provide an enhanced thermal dissipation pathway between these structures. The dielectric blocks 80 and 82, and the dielectric blocks 58-72, can be made from Boron-Nitride loaded Teflon although other dielectrics can be used such as alumina, steatite, beryllium oxide, aluminum nitride and the like. Liquid low loss dielectrics can also be used, such as some silicones for example. The size of the dielectric blocks 80 and 82 can be varied depending on the amount of RF power being handled by the combiner 10'.

Figure 7:
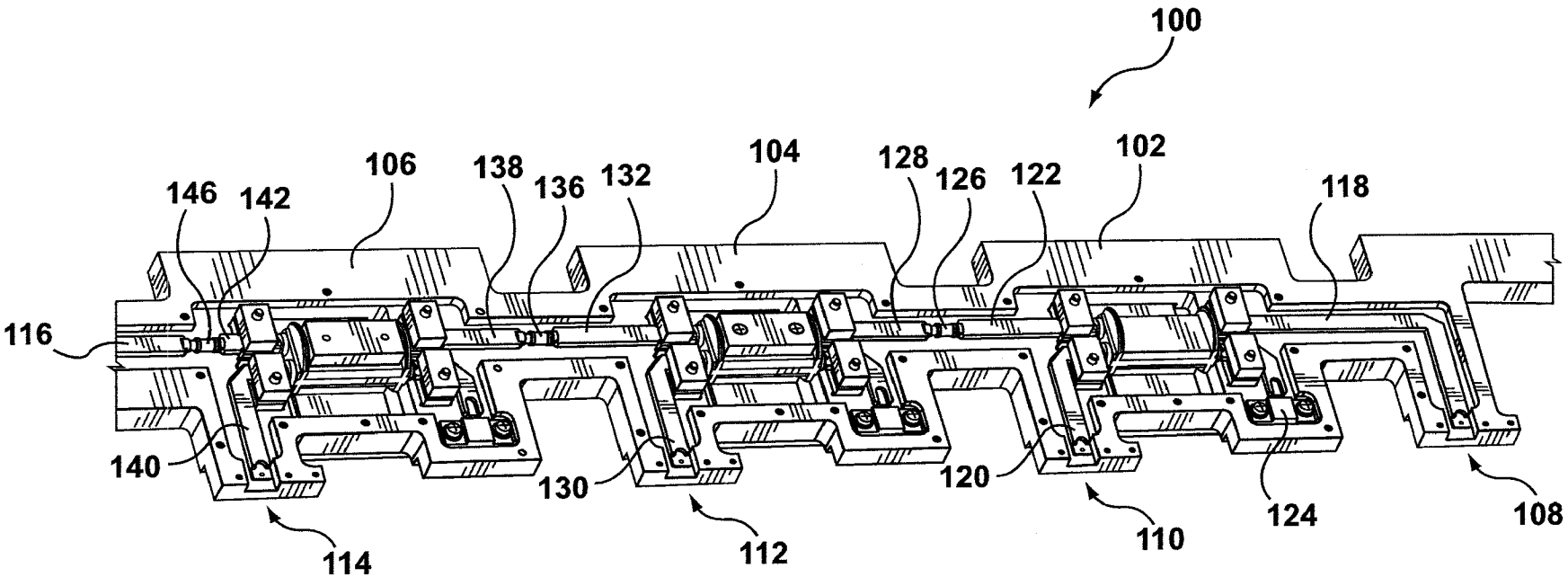
FIG. 7 is a perspective view of an exemplary embodiment of a 4:1 chain combiner.

Referring now to FIG. 7, shown therein is a perspective view of an exemplary embodiment of a 4:1 chain combiner 100 with the upper portion of the housing removed. The chain combiner 100 includes three couplers 102, 104 and 106, input ports 108, 110, 112, and 114 and an output port 116. The three couplers 102, 104 and 106 have different coupling factors due to the different amount of power that are being coupled. In one exemplary implementation, the coupler 102 can be a 3 dB coupler, the coupler 104 can be a 4.77 dB coupler and the coupler 106 can be a 6 dB coupler. Since the couplers 104 and 106 deal with a greater amount of RF power, these couplers employ the design of combiner 10' with the additional dielectric blocks on the intermediate conductor. The coupler 102 employs the design of the combiner 10.

The coupler 102 includes input transmission lines 118 and 120, output transmission line 122 and an isolated transmission line 124. The coupler 104 includes input transmission lines 128 and 130, output transmission line 132 and an isolated transmission line 134. The coupler 106 includes input transmission lines 138 and 140, output transmission line 142 and an isolated transmission line 144. The output transmission line 122 of coupler 102 is electrically connected to the input transmission line 128 of coupler 104 via a connector 126. The output transmission line 132 of coupler 104 is electrically connected to the input transmission line 138 of coupler 106 via a connector 136. Finally, the output transmission line 142 of coupler 106 is electrically connected to the output port 116 via a connector 146.

Since the chain combiner 100 uses couplers with designs similar to those of combiners 10 and 10', the chain combiner 100 has good wide band frequency performance while being able to accommodate high RF power. In one example, an implementation of the chain combiner 100 was able to combine signals with RF power in excess of 10 kW at the L-band.

The couplers 104 and 106 of the chain combiner 100 require additional dielectric blocks because in the chain combiner 100, the incident RF power increases as the signals move toward the output 116 of the chain combiner 100. However, since the characteristic impedance of the intermediate conductor with respect to ground decreases as the coupling value is decreased, the coupler that combines the highest amount of power level (i.e. the 6 dB coupler 106) also has the lowest characteristic impedance for the intermediate conductor. Consequently, the coupler which needs the highest power dissipation capability (i.e. the 6 dB coupler 106), will have the shortest distance from the inner conductor to ground, and hence the shortest and best thermal path to ground. Accordingly, this particular design characteristic provides a favorable impedance change with a coupling value change.

The concept of modifying a floating intermediate conductor by including capacitive loaded regions in a re-entrant coupler or combiner, to compensate for different odd and even mode propagation constants is not restricted to coax embodiments. This concept can also be extended to stripline and microstrip embodiments. In these cases, the use of a dielectric material with good thermal conductivity properties and a capacitively loaded floating intermediate conductor allows for the production of combiners with better heat dissipation characteristics, and hence higher power handling characteristics, as well as for much more design flexibility in selecting dielectric materials and heights for the substrates that are used.

For conventional reentrant combiners made using strip or microstrip designs, specific substrate heights must be used as well as dielectric materials having specific dielectric constants. This can be a serious limitation, since for a particular coupling factor value, dielectric materials with the specific required dielectric constant may not be readily available. However, using a capacitive loaded floating intermediate conductor, as is described herein, a stripline or microstrip combiner can be made using standard substrates. Also, because such a combiner can use wide transmission lines with characteristic impedances less than 50 ohm, the space between the transmission lines can be made larger than the substrate height and this kind of combiner can operate at much higher peak powers than other stripline or microstrip designs. The stripline or microstrip line versions of the modified combiner (i.e. with a capacitively loaded intermediate conductor) can also be used in a chain combiner.

Figure 8:
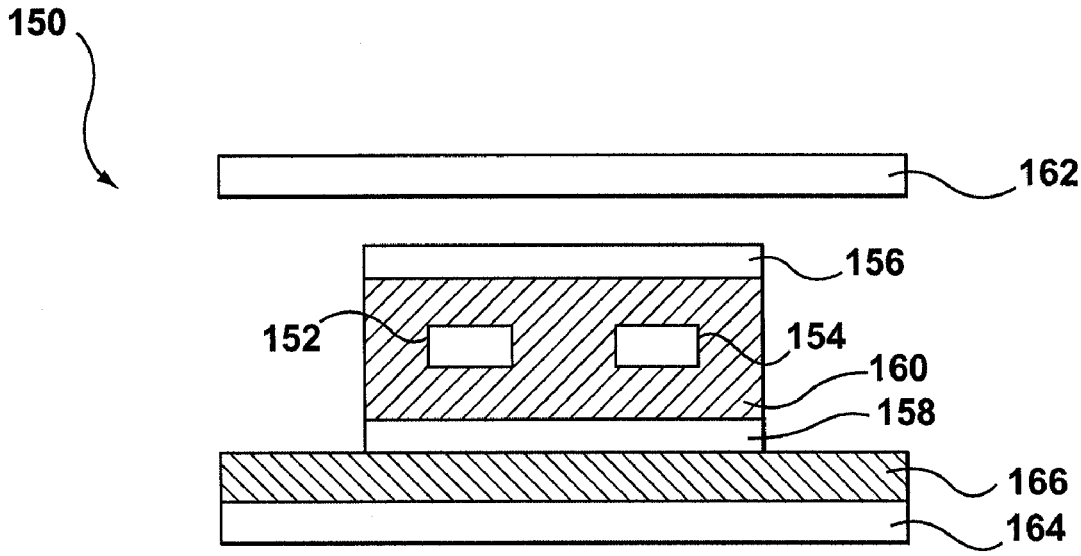
FIG. 8 is an end view of a portion of another exemplary embodiment of a combiner.
Figure 9:
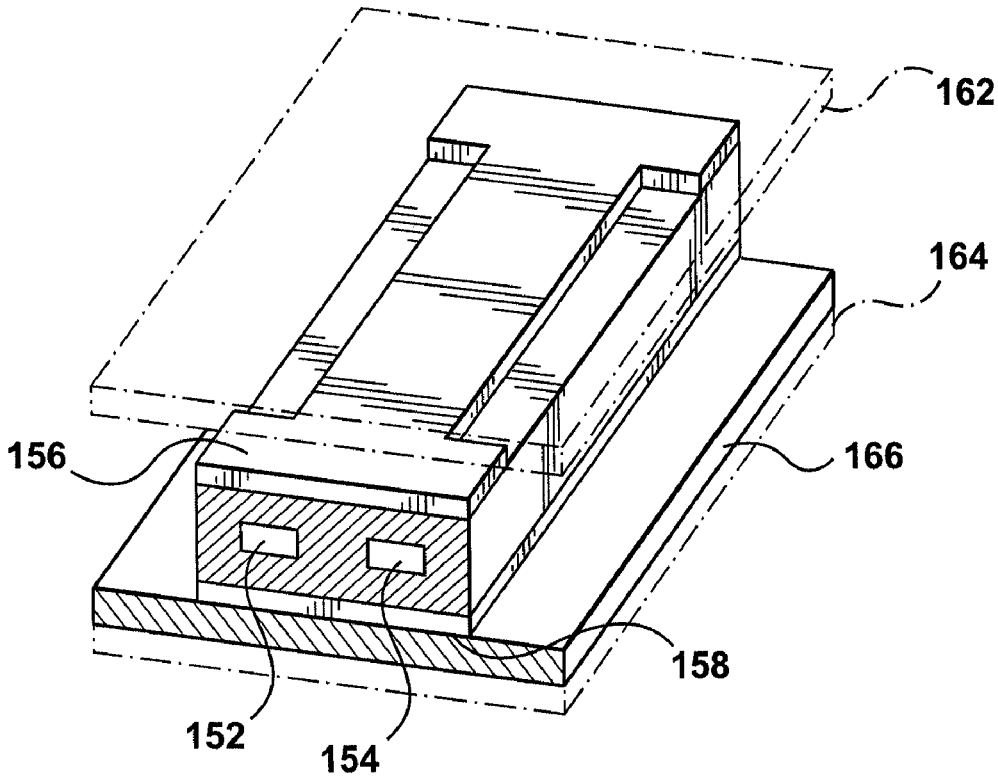
FIG. 9 is a perspective view of a portion of the combiner of FIG. 8.

Referring now to FIGS. 8 and 9, shown therein is an end view and a perspective view of a portion of another exemplary embodiment of a combiner 150. The combiner 150 includes transmission lines 152 and 154 in the form of a pair of parallel strip conductors in a common plane. The combiner 150 also includes another pair of parallel strip conductors 156 and 158 disposed above and below the strip conductors 152 and 154 in parallel planes. The strip conductors 156 and 158 provide an intermediate conductor arrangement that defines a first region that includes the strip conductors 156 and 158. The combiner 150 further includes a dielectric material 160 disposed within the region. The combiner 150 further includes strip conductors 162 and 164 disposed in parallel planes above and below the strip conductors 156 and 158. The strip conductors 162 and 164 provide an electrical ground and a housing for the combiner 150. The strip conductors 162 and 164 also provide an outer conductor arrangement for the combiner 150. Ports can be connected on each end of the transmission lines 152 and 154. The combiner 150 also includes a dielectric substrate layer 166 between the strip conductors 158 and 164.

The fact that there is dielectric material between the strip conductors 152 and 154 and the strip conductors 156 and 158 while there is not any corresponding dielectric material between the strip conductors 156 and 162, while in between the strip conductors 156 and 164 there is dielectric 166, results in an imbalance in the even and odd mode propagation constants. In order to compensate for this imbalance such that one of the ports of combiner 150 is isolated, the intermediate conductor arrangement is capacitively loaded. Accordingly, the strip conductor 156 includes capacitive portions 166, 168, 170 and 172 near each corner. The strip conductor 158 also includes corresponding capacitive portions 174, 176, 178 and 180 near each corner. Many other various types of shapes can be used for these capacitive portions. This design also has the same wideband characteristic as combiners 10 and 10' if the design properly balances the odd and even electrical lengths. The dielectric material that can be used for dielectrics 160 and 166 include, but are not limited to, ceramic-loaded Teflon, fiberglass reinforced Teflon, glass reinforced hydrocarbon/ceramic laminate, and the like.

For conventional combiners having a microstrip design, the equality between the even and odd mode propagation velocities is lost. To mitigate the disparity, one approach can be to use dielectric materials with specific dielectric constants, which may not be readily available, to regain equality. However, the need for dielectric materials with specific dielectric constants, i.e. using different dielectric materials for each layer, and having a specific ratio of dielectric constants between different layers, is a design-limiting factor which is cumbersome. Hence the conventional microstrip approach is rarely used. Also, because of the required interrelationship of the characteristic impedances, coupling values can be encountered in practice for which the readily available dielectric materials do not work; i.e. the dielectric ratio is not the correct required ratio, or some conductor width or other mechanical issue (i.e. ground spacing) becomes unpractical. However, if capacitive loading is used in the microstrip case for the intermediate conductor, there is no need for specific dielectric constants. Different dielectric materials are still used, but by using capacitive loading for the intermediate conductor arrangement, a wide range of coupling values can be achieved using existing readily available dielectric materials.

Figure 10:
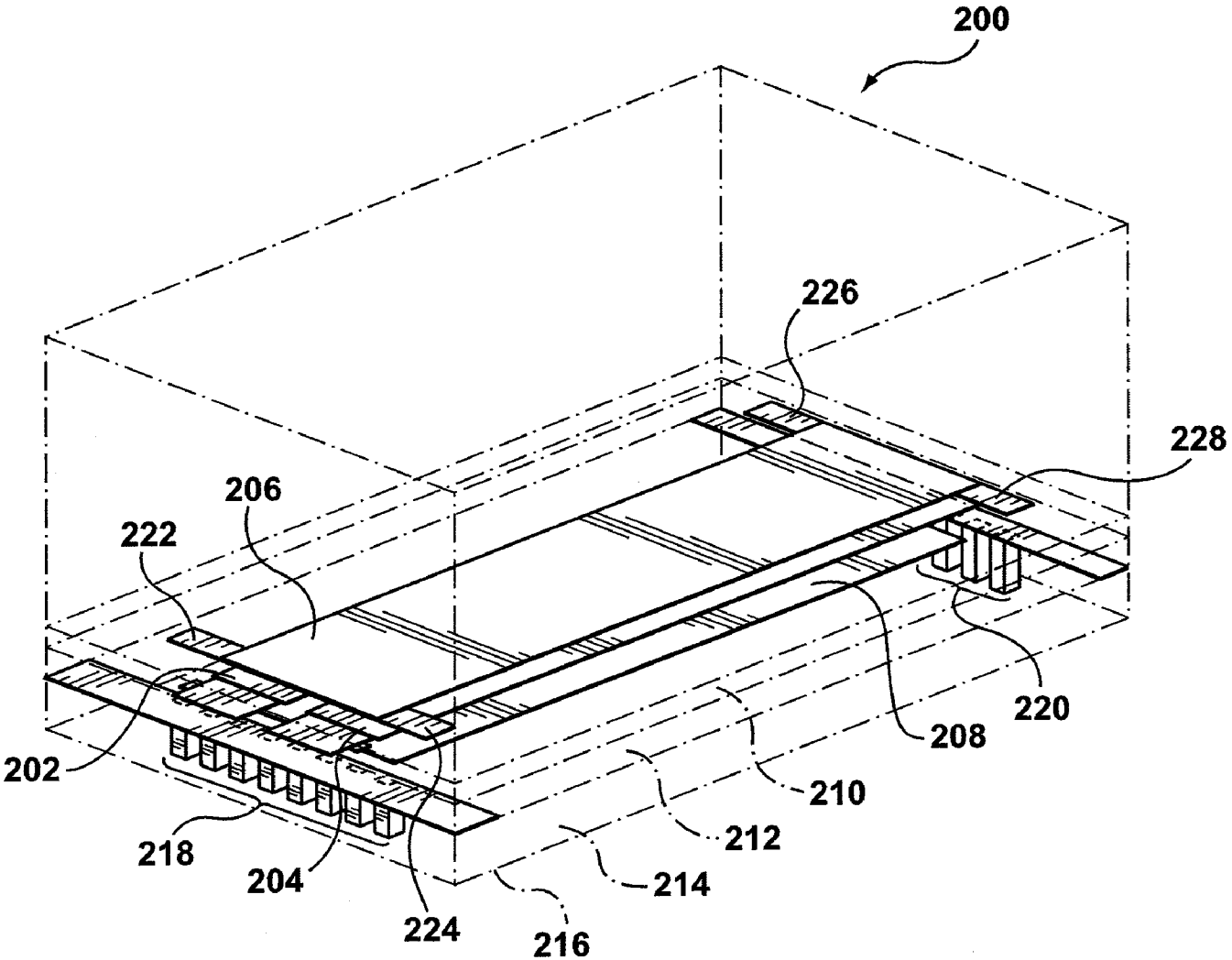
FIG. 10 is a perspective view of another exemplary embodiment of a combiner.

Referring now to FIG. 10, shown therein is a perspective view of another exemplary embodiment of a combiner 200. The combiner 200 includes transmission lines 202 and 204 in the form of a pair of parallel strip conductors in a common plane. The combiner 200 also includes another pair of parallel strip conductors 206 and 208 disposed above and below the strip conductors 202 and 204 in parallel planes. The strip conductors 206 and 208 provide an intermediate conductor arrangement that defines a first region that includes the strip conductors 202 and 204. The combiner 200 further includes several layers of dielectric materials shown in ghost lines in FIG. 10. The combiner 200 includes a dielectric material 210 disposed within the first region about the strip conductors 202 and 204 and between the strip conductor 202 and 206. The combiner 200 also includes a layer of dielectric material 212 between the strip conductors 202 and 208, and another layer of dielectric material 214 beneath the strip conductor 208 (i.e. beneath the layer of dielectric material 212). The combiner 200 further includes a housing 216, which provides an outer conductor arrangement and an electrical ground for the combiner 200. The housing is shown as defined by a simulator. In practice, in a microstrip application, the housing is a milled pocket in a chassis to place the dielectric material 214. Further, the dielectric material 210 can be added only, i.e. a piece cut to the desired dimension defined by the dimension of strip conductor 206 which also carries conductor 206. In this case, the dielectric material 212 can act as the general substrate for the rest of the microstrip circuit. The combiner 200 also includes a plurality of vias 218 and 220 to ground on both sides of the combiner 200 that includes input and output ports, as the case may be. Ports can be connected on each end of the transmission lines 202 and 204.

Accordingly, in the microstrip case, depending on the coupling factor desired, a dielectric will also exist between the conductor 208 and ground but between the conductor 206 and the upper ground (i.e. upper portion of the housing) there is no need for a non-air dielectric. In addition, the microstrip case is also QUASI-TEM. For these two reasons, there is a significant difference in the propagation constant associated with the strip conductor 206 and the rest of the combiner 200. However, since conductors 206 and 208 are the equivalent of the floating intermediate conductor, it follows that by default the electrical length of the conductors 156 and 158 are the same. It follows that either a different dielectric must be used between conductors 206 and 204, in contrast with the dielectric between 204 and 208, with a certain ratio for these dielectrics, which is very cumbersome, or capacitive loading is used on the strip conductor 206, to equalize the electrical lengths associated with the even and odd mode, which is far easier to implement in practice. Accordingly, the strip conductor 206 includes capacitive loads 222-228 in the form of stubs near the end portions of each corner. Please note that the term "equalize" means that the odd and even mode electrical lengths are as similar to one another as is practically possible so that one of the ports of the combiner 200 is isolated. Furthermore, for specific coupling factors or dielectric constants, capacitive loading can be used on both the conductors 206 and 208 and in this case the amount of capacitive loading on each of these conductors can be different. Accordingly, capacitive loading provides a great degree of design flexibility and implementation for the microstrip case. The dielectric materials for the can be used for dielectrics 210, 212 and 214 include, but are not limited to, ceramic-loaded Teflon, fiberglass reinforced Teflon, glass reinforced hydrocarbon/ceramic laminate, and the like. During the design of the combiner 200, the design simulator that is used can provide initial requirements for the dielectric constants of each of the dielectrics 210, 212 and 214, as is known by those skilled in the art. The next step in the design is to select the amount of capacitive loading that is required to equalize the electrical lengths as taught herein. Selection the amount of capacitive loading can also be varied to adjust the initial requirements for the dielectric constants to be more favorable.

The various embodiments of the combiners described herein allow for the compensation of unequal odd and even mode propagation constants, which can result for different reasons, by using a capacitively loaded intermediate conductor arrangement. At least some of the embodiments described herein allow for the combination of high power RF signals in a small physical volume with low loss, have wide-band RF performance, good thermal dissipation capability, and insensitivity to misalignment/thermal expansion. Coupling is not sensitive to the small movements of the floating intermediate conductor within the combiner due to assembly errors or thermal expansion.

In some circumstances, the coax embodiments described herein have a high RF power capability for dealing with RF power far in excess of 10 kW peak or 1000 Watts on average due to the various heat dissipation paths that can be included in the combiner. For instance, a first improved heat dissipation path exists from the portion of the transmission lines that are enclosed within the intermediate conductor arrangement with the use of the dielectric material that is disposed about this portion of the transmission lines to provide a thermal path to the intermediate conductor arrangement.

In the coax case, if a greater amount of heat dissipation is required to deal with a larger amount of RF power, then additional improved heat dissipation paths can be included from the portion of the transmission lines that are external to the intermediate conductor arrangement by adding dielectric blocks or dielectric material to this region of the transmission lines to provide a better thermal path to the outer conductor arrangement. In fact, the highest electric field intensity is located at the region of the two transmission lines just external to the intermediate conductor arrangement. Accordingly, depending on the amount of RF power being handled by the combiner, it may be necessary to include dielectric material or dielectric blocks in this region.

If an even greater amount of heat dissipation is required to deal with an even larger amount of RF power, then additional improved heat dissipation paths can be included between the intermediate conductor arrangement and the outer conductor arrangement by adding dielectric blocks or dielectric material between these two structures. In some embodiments, a liquid low-loss dielectric material, such as some silicones for example, can also be used to improve heat dissipation.

At least the coax embodiments described herein also provide high bandwidth and combining efficiency. In fact, when the design operation frequency is decreased, the peak and average power capability of the combiner increases very fast because the power goes up by the square of the voltage breakdown limit which is in direct relation with the actual dimensions. For example, when designing the reentrant combiner according to the techniques provided herein, for the lower part of the UHF band or for the VHF band, the combiner can have a peak power capability in the mega-Watt range. No other stripline/coax 3 dB combiner can do this. In addition, the directivity and Voltage Standing Wave Ratio (VSWR) of the coaxial combiner are insensitive to thermal expansion.

In addition, the bandwidth in which couplers can typically actually be used in practice as efficient combiners is determined by the return loss bandwidth and not by the coupling bandwidth since the return loss bandwidth is always narrower than the coupling bandwidth. The type of capacitive loading described herein for the various combiner embodiments, does not restrict or deteriorate return loss bandwidth or return loss performance. Also, the dielectric material added to the 50 ohm lines does not form any kind of reactive loading. For instance, for the coax embodiments, the dielectric blocks used on the portion of the two transmission lines exterior to the intermediate conductor arrangement do not form any kind of reactive loading since the characteristic impedance is maintained at 50 ohms inside the dielectric blocks as well as outside. Further, the dielectric introduced material disposed about the portion of the transmission lines internal to the intermediate conductor arrangement do not provide any reactive (i.e. capacitive) loading because the electrical length of the conductors is not reduced with respect to 90 degrees and because the characteristic impedance of these lines is not changed.

Furthermore, the various embodiments for the combiner described herein can be used in practice for example from about 100 MHz up to about the X-band (i.e. 12,000 MHz). At frequencies lower than 1,000 MHz, the peak power capability can exceed 1 Megawatt in certain situations for certain embodiments excluding microstrip embodiments.

In one aspect, at least one embodiment described herein provides a combiner comprising: first and second transmission lines; a dielectric material disposed about the first and second transmission lines, the dielectric material having a dielectric constant higher than that of air; an intermediate conductor arrangement disposed about the dielectric material, the intermediate conductor arrangement having reactive portions; and an outer conductor arrangement disposed about the intermediate conductor.

In another aspect, at least one embodiment described herein provides a chain combiner comprising a plurality of combiners connected in series. At least one of the combiners comprises: first and second transmission lines; a dielectric material disposed about the first and second transmission lines, the dielectric material having a dielectric constant higher than that of air; an intermediate conductor arrangement disposed about the dielectric material, the intermediate conductor arrangement having reactive portions; and an outer conductor arrangement disposed about the intermediate conductor.

In another aspect, at least one embodiment described herein provides a directional coupler comprising: first and second transmission lines; a dielectric material disposed about the first and second transmission lines, the dielectric material having a dielectric constant higher than that of air; an intermediate conductor arrangement disposed about the dielectric material, the intermediate conductor arrangement having a capacitive loading configured to provide similar odd and even electrical lengths for the portions of the first and second transmission lines within the intermediate conductor arrangement; and an outer conductor arrangement disposed about the intermediate conductor.

While certain features have been illustrated and described for the various embodiments discussed herein, modifications, substitutions, changes, and equivalents can be made, without departing from the scope of these embodiments as defined in the appended claims.

The invention claimed is:

1. A directional coupler having four ports, the directional coupler comprising:

first and second transmission lines arranged side-by-side, each of the first and second transmission lines having a first end coupled to a respective one of four ports of the directional coupler;

a dielectric material disposed about the first and second transmission lines, the dielectric material having a dielectric constant higher than that of air;

an intermediate conductor arrangement disposed about the dielectric material, the intermediate conductor arrangement having a capacitive loading configured to provide similar odd and even electrical lengths for the portions of the first and second transmission lines within the intermediate conductor arrangement; and an outer conductor arrangement disposed about the intermediate conductor.

2. A combiner having four ports, the combiner comprising:

first and second transmission lines arranged side-by-side, each of the first and second transmission lines having a first end coupled to a respective one of four ports of the combiner and having a second end coupled to a respective one of four ports of the combiner;

a dielectric material disposed about the first and second transmission lines, the dielectric material having a dielectric constant higher than that of air;

an intermediate conductor arrangement disposed about the dielectric material, the intermediate conductor arrangement having reactive portions wherein the reactive portions are configured to provide additional electrical length to equalize the odd and even electrical length of the first and second transmission lines with respect to the intermediate conductor arrangement; and an outer conductor arrangement disposed about the intermediate conductor.

3. The combiner of claim 2, wherein the reactive portions are capacitive portions located near end portions of the intermediate conductor arrangement.

4. The combiner of claim 3, wherein the capacitive portions are semi-circular plates.

5. The combiner of claim 3, wherein the capacitive portions have the same shape.

6. The combiner of claim 2, wherein the first and second transmission lines comprise first and second coaxial conductor portions, respectively, disposed within the intermediate conductor arrangement, the dielectric material is disposed about the first and second coaxial conductors, and the intermediate conductor arrangement comprises two channels sized to receive the dielectric material and the first and second coaxial conductors.

7. The combiner of claim 6, wherein the combiner further comprises at least one dielectric block on at least one surface of the first and second transmission lines exterior of the intermediate conductor arrangement, the at least one dielectric block being in thermal communication with the outer conductor arrangement which provides an electrical ground.

8. The combiner of claim 6, wherein the first and second transmission lines further comprise thick strip conductor portions electrically connected to the coaxial conductor portions.

9. The combiner of claim 6, wherein the combiner further comprises shield elements disposed between the first and second transmission lines exterior of the intermediate conductor arrangement.

10. The combiner of claim 7, wherein the at least one dielectric block corresponds to a first dielectric block and the combiner further comprises at least one additional dielectric block in thermal communication with the intermediate conductor arrangement and the outer conductor arrangement.

11. The combiner of claim 7, wherein the combiner further comprises four dielectric blocks, each of the dielectric blocks being in thermal communication with a surface of the first and second transmission lines exterior of the intermediate conductor arrangement and the outer conductor arrangement.

12. The combiner of claim 2, wherein the first and second transmission lines comprise first and second parallel strip conductors in a common plane, the intermediate conductor arrangement comprises third and fourth parallel strip conductors disposed above and below the first and second strip conductors and defining a region therebetween, the first and second strip conductors being contained within the region, and the dielectric material being disposed within the region.

13. The combiner of claim 12, wherein the reactive portions are capacitive portions located near or on end portions of the third and fourth strip conductors.

14. The combiner of claim 12, wherein the dielectric material fills the region.

15. The combiner of claim 2, wherein the outer conductor arrangement provides an electrical ground and forms a housing for the combiner.

16. The combiner of claim 2, wherein the first and second transmission lines comprise first and second parallel strip conductors in a common plane, the intermediate conductor arrangement comprises third and fourth parallel strip conductors disposed above and below the first and second strip conductors and defining a region therebetween, the first and second strip conductors being contained within the region, the dielectric material comprises first and second dielectric portions, the first dielectric portion being disposed between the third conductor strip and the plane containing the first and second strip conductors, and the second dielectric portion being disposed between the plane containing the first and second strip conductors and the fourth conductor strip.

17. A combiner comprising:

first and second transmission lines;

a dielectric material disposed about the first and second transmission lines, the dielectric material having a dielectric constant higher than that of air;

an intermediate conductor arrangement disposed about the dielectric material, the intermediate conductor arrangement having reactive portions wherein the reactive portions are configured to provide additional electrical length to equalize the odd and even electrical length of the first and second transmission lines with respect to the intermediate conductor arrangement and wherein the reactive portions are capacitive portions located near end portions of the intermediate conductor arrangement and wherein the capacitive portions have a varying width for varying the odd mode electrical length for a range of frequencies; and an outer conductor arrangement disposed about the intermediate conductor.

18. A combiner comprising:

first and second transmission lines, wherein the first and second transmission lines comprise first and second parallel strip conductors in a common plane;

a dielectric material disposed about the first and second transmission lines, the dielectric material having a dielectric constant higher than that of air;

an intermediate conductor arrangement disposed about the dielectric material, the intermediate conductor arrangement having reactive portions wherein the reactive portions are configured to provide additional electrical length to equalize the odd and even electrical length of the first and second transmission lines with respect to the intermediate conductor arrangement wherein the intermediate conductor arrangement comprises third and fourth parallel strip conductors disposed above and below the first and second strip conductors and defining a region therebetween, the first and second strip conductors being contained within the region, and the dielectric material being disposed within the region; and an outer conductor arrangement disposed about the intermediate conductor wherein the outer conductor arrangement comprises fifth and sixth parallel strip conductors disposed above and below the third and fourth conductors and defining a second region containing the third and fourth strip conductors, and additional dielectric material disposed between the fourth and sixth parallel strip conductors.

19. A combiner comprising:

first and second transmission lines wherein the first and second transmission lines comprise first and second parallel strip conductors in a common plane;

a dielectric material disposed about the first and second transmission lines, the dielectric material having a dielectric constant higher than that of air;

an intermediate conductor arrangement disposed about the dielectric material, the intermediate conductor arrangement having reactive portions wherein the reactive portions are configured to provide additional electrical length to equalize the odd and even electrical length of the first and second transmission lines with respect to the intermediate conductor arrangement wherein the intermediate conductor arrangement comprises third and fourth parallel strip conductors disposed above and below the first and second strip conductors and defining a region therebetween, the first and second strip conductors being contained within the region, the dielectric material comprises first and second dielectric portions, the first dielectric portion being disposed between the third conductor strip and the plane containing the first and second strip conductors, and the second dielectric portion being disposed between the plane containing the first and second strip conductors and the fourth conductor strip;

an outer conductor arrangement disposed about the intermediate conductor; and wherein the combiner further comprises a third dielectric portion disposed between the fourth conductor strip and the outer conductor arrangement.

20. The combiner of claim 19, wherein:

the reactive portions further comprise at least one of: capacitive portions located near end portions of the third strip conductor and capacitive portions located near end portions of the fourth strip conductor; and at least one of the capacitive portions is provided as a stub.

21. A chain reentrant combiner comprising a plurality of combiners connected in series, wherein at least one of the combiners comprises:

first and second transmission lines;

a dielectric material disposed about the first and second transmission lines, the dielectric material having a dielectric constant higher than that of air;

an intermediate conductor arrangement disposed about the dielectric material, the intermediate conductor arrangement having reactive portions; and an outer conductor arrangement disposed about the intermediate conductor.

* * * * *

UNITED STATES PATENT AND TRADEMARK OFFICE

CERTIFICATE OF CORRECTION

PATENT NO. : 7,683,734 B2
APPLICATION NO. : 11/686676
DATED : March 23, 2010
INVENTOR(S) : Miron Catoiu It is certified that error appears in the above-identified patent and that said Letters Patent is hereby corrected as shown below:

Column 6, line 60 delete "reentrant" and replace with --re-entrant--.

Column 8, line 19 delete "conductor" and replace with --conductors--.

Column 8, line 67 delete "for the" and replace with --that--.

Column 9, line 9 after "Selection" insert --of--.

Column 9, line 61 delete "reentrant" and replace with --re-entrant--.

Column 14, line 20 delete "reentrant" and replace with --re-entrant--.

Signed and Sealed this

Twenty-fifth Day of May, 2010

David J. Kappos

David J. Kappos
*Director of the United States Patent and Trademark Office*